United States Patent [19]

McGivern

[11] Patent Number: 4,549,320

[45] Date of Patent: Oct. 29, 1985

[54] CONVERTIBLE FURNITURE

[75] Inventor: James F. McGivern, Accrington, England

[73] Assignee: Beconpatch Limited, Macclesfield, England

[21] Appl. No.: 624,597

[22] Filed: Jun. 26, 1984

[51] Int. Cl.[4] ..... A47B 83/00; A47B 85/00

[52] U.S. Cl. ..... 5/2 R; 5/8; 273/5 R

[58] Field of Search ..... 5/8, 3, 9 R, 9 B, 2 R, 5/312; 273/5 R, 5 C

[56] References Cited

U.S. PATENT DOCUMENTS

| | | | |
|---|---|---|---|
| 244,324 | 7/1881 | Sherman | 273/5 R |
| 3,341,198 | 9/1967 | Turpin | 273/5 R |

FOREIGN PATENT DOCUMENTS

| | | | |
|---|---|---|---|
| 83783 | 2/1921 | Austria | 5/8 |
| 1449807 | 7/1966 | France | 5/8 |
| 798935 | 7/1958 | United Kingdom | 5/8 |
| 846878 | 8/1960 | United Kingdom | 5/8 |
| 251789 | 2/1970 | U.S.S.R. | 5/9 R |

*Primary Examiner*—Alexander Grosz

*Attorney, Agent, or Firm*—Pearson & Pearson

[57] ABSTRACT

Furniture which is convertible so as to provide a table for playing snooker or the like or alternatively a bed, comprises two parts each of box-like construction and of like rectangular planform. One part has an upper surface in the form of a snooker table while the other part has upstanding side and endwalls which retain a mattress and bedding thereon. The part in use stands on top of the part not in use to conserve space in the home.

3 Claims, 3 Drawing Figures

CONVERTIBLE FURNITURE

This invention relates to convertible furniture.

In recent years there has been an increase in the interest shown by the general public in the game of snooker, and perhaps to a lesser extent the related games of pool and billiards. This increase in interest has created a greater desire to play one or more of these games at home. However, in order to play such a game a suitable table is required and purpose built tables for such games are not only costly but also take up a considerable amount of space in the home, which space is generally not available in many homes. For this reason, convertible tables have been produced whereby the games table may be converted into an ordinary domestic dining table when not required for playing a game thereon. Although such an arrangement is a fairly satisfactory compromise certain disadvantages are often associated therewith. In many homes the dining room is either relatively small or is simply an extension of the living room, and in such cases it may be difficult to accommodate a table of sufficient size so as to be convertible into a games table of a size desired. Also a dining table is often required several times a day for meals and for other domestic pursuits and it can be inconvenient to keep converting the table from one configuration to another in order that it may be used for its alternative purposes. In addition, people not wishing to play a game may wish to use the dining room for other purposes.

It is an object of the present invention to provide a piece of convertible furniture in use of which the above disadvantages are avoided or at least reduced to a substantial extent.

The invention provides convertible furniture comprising two parts, one part having a top surface adapted for the playing of snooker or the like game thereon and the other part being adapted to receive a mattress thereon, said two parts being interchangeably disposable one above the other.

By means of the invention the article of furniture, hereinafter referred to as a games table, is readily convertible from a games table configuration to a bed configuration. In general a bedroom is not used for the purposes of sleeping or for any other purpose during the day, and in consequence there will generally be no disadvantages accruing from the bed therein being in the configuration of a games table. The furniture of the invention need be changed from the bed configuration to the games table configuration and back to the bed configuration once in a day, or if the bedroom is one which is not in regular use, i.e. a guest's bedroom, then the furniture may be left normally in the games table configuration and only converted into the bed configuration when required.

Each furniture part may be of rectangular box-like construction and of like planform.

Said one part may have a leg disposed at each corner of its lower surface. The upper surface of said one part may have six apertures therein communicating with the interior of said box, which interior may have a floor inclined relative to said upper surface whereby in use a ball passing through one of said apertures will roll to one end of said interior. An aperture may be provided in an end wall of one part whereby a ball may be retrieved from said interior thereof.

Said other part may be of an open-topped box-like construction whereby a mattress may be received therein and located by side and end walls thereof. Said other part may also have legs attached to the underside thereof, and said legs may be pivotal between operative positions whereby said other part may be supported thereby and inoperative positions in which each leg lies substantially in a plane parallel with said underside.

The furniture may also comprise a headboard which is releasably attachable to said other part at one end thereof.

One embodiment of furniture in accordance with the invention will now be described with reference to the accompanying drawings in which.

Figure 1:
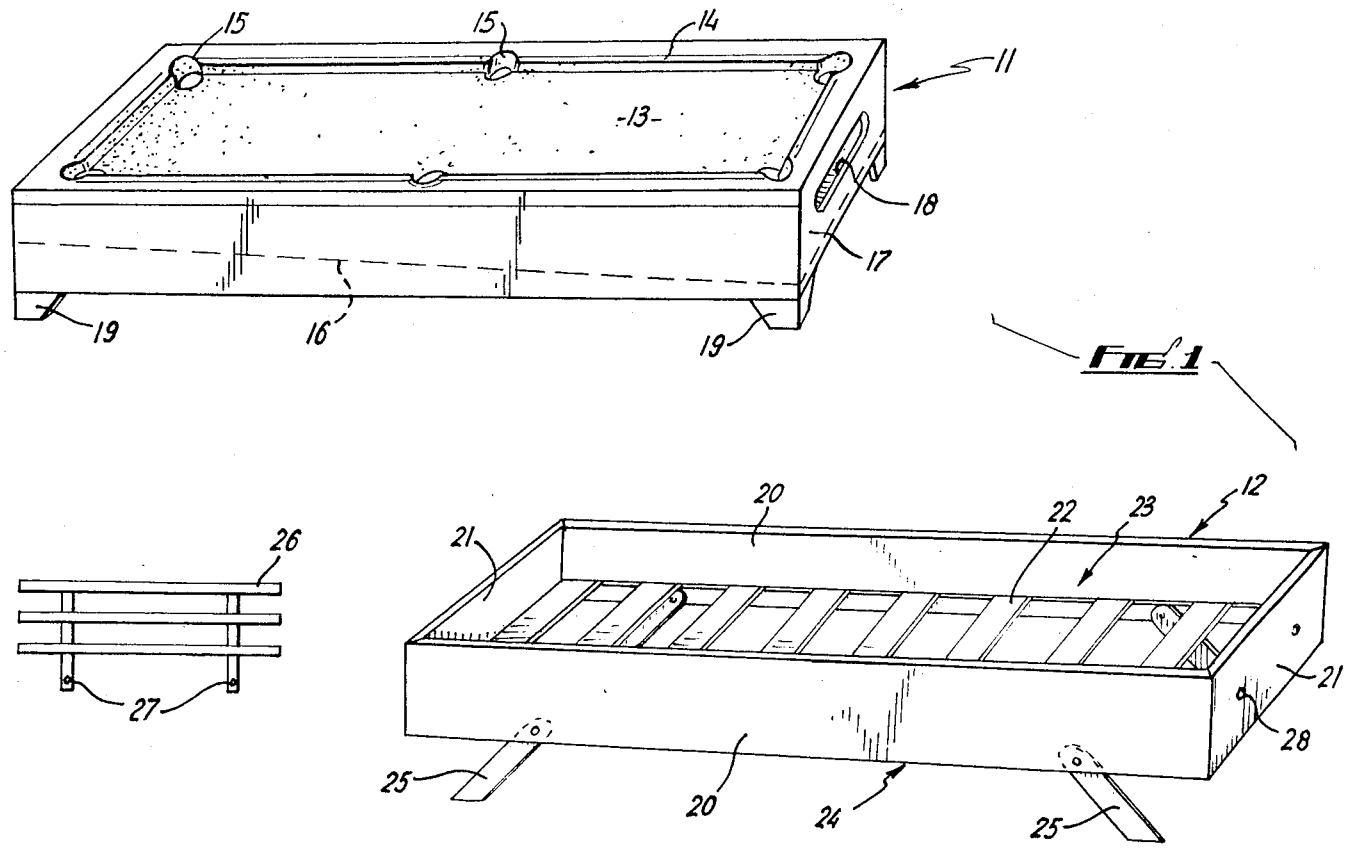
FIG. 1 is a perspective view of the constituent parts of the furniture.

Referring now to FIG. 1 there is shown two parts 11,12 of the convertible furniture, each part being of rectangular box-like construction and the two parts being of like planform.

One part 11 is adapted for the playing of snooker or the like game thereon. The upper surface 13 has walls or 'cushions' 14 extending therearound and six apertures or 'pockets' 15 as is conventional for the playing of such games. The surface 13 and cushions 14 are covered with a green baize or like material and surface 13 has appropriate markings thereon (not shown) as is conventional in the art. The pockets 15 communicate with the interior of the part 11, which interior has a floor 16 (shown by the dashed lines) which is inclined relative to upper surface 13 downwardly towards one end 17 of part 11. In end 17 there is provided an aperture 18 so that balls which pass through the pockets 15 and roll along floor 16 can be retrieved when required. Legs 19 are provided, one at each corner of the underside of part 11.

Part 12 is of open-topped box-like construction, having sidewalls 20, endwalls 21 and a slatted floor 22. The walls 20, 21 extend both above and below the floor 22 thereby providing upper and lower recesses 23, 24. Upper recess 23 is of a size to receive a mattress therein so that part 12 may be used as a bed. The part 12 is provided with legs 25 which are pivotally mounted on the inside of side walls 20 so as to extend beneath part 12 when in an operating position as shown, and to lie within lower recess 24 when in a non-operating position.

A headboard 26 is also provided, the uprights of which are provided with bores 27. Corresponding bores 28 are provided in one end wall 21 of part 12 so that the headboard 26 can be quickly and easily attached to and removed from part 12 when desired using bolts and wing nuts (not shown). Alternative forms of attachment of headboard 26 to part 12 will be readily apparent to persons skilled in the art.

Figure 2:
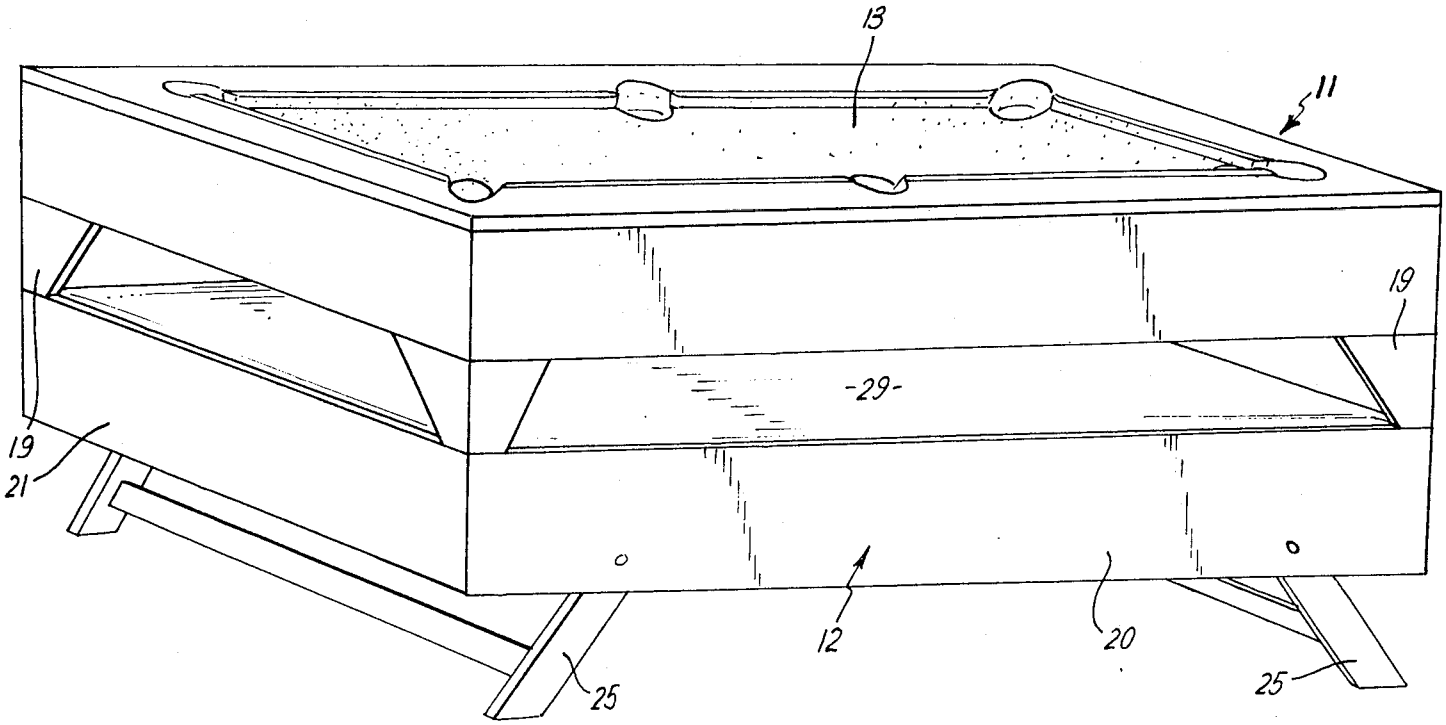
FIG. 2 is a perspective view of the furniture of FIG. 1 in the games table configuration, and, FIG. 3 is a perspective view of the furniture of FIG. 1 in the bed configuration.

The furniture shown in FIG. 1 is used as follows. As shown in FIG. 2 part 11 may be placed above, i.e. on top of, part 12. The two parts 11, 12 being of like planform may be placed in alignment with each other, as shown, legs 19 of part 11 resting on the corners of the side and end walls 20,21 of part 12. The legs 25 of part 12 are extended to the operative position. The furniture is then in the games table configuration, the combined depth of parts 11 and 12 providing that the upper surface 13 of part 11 is at a suitable height for the playing of snooker or the like. If part 12 has a mattress and any other bedding thereon it can remain thereon in the desired arrangement thereof, being located between parts 11 and 12 as shown at 29, legs 19 allowing for the thickness of such bedding. The headboard 26 is removed from part 12 when the furniture is in the games table configuration.

Figure 3:
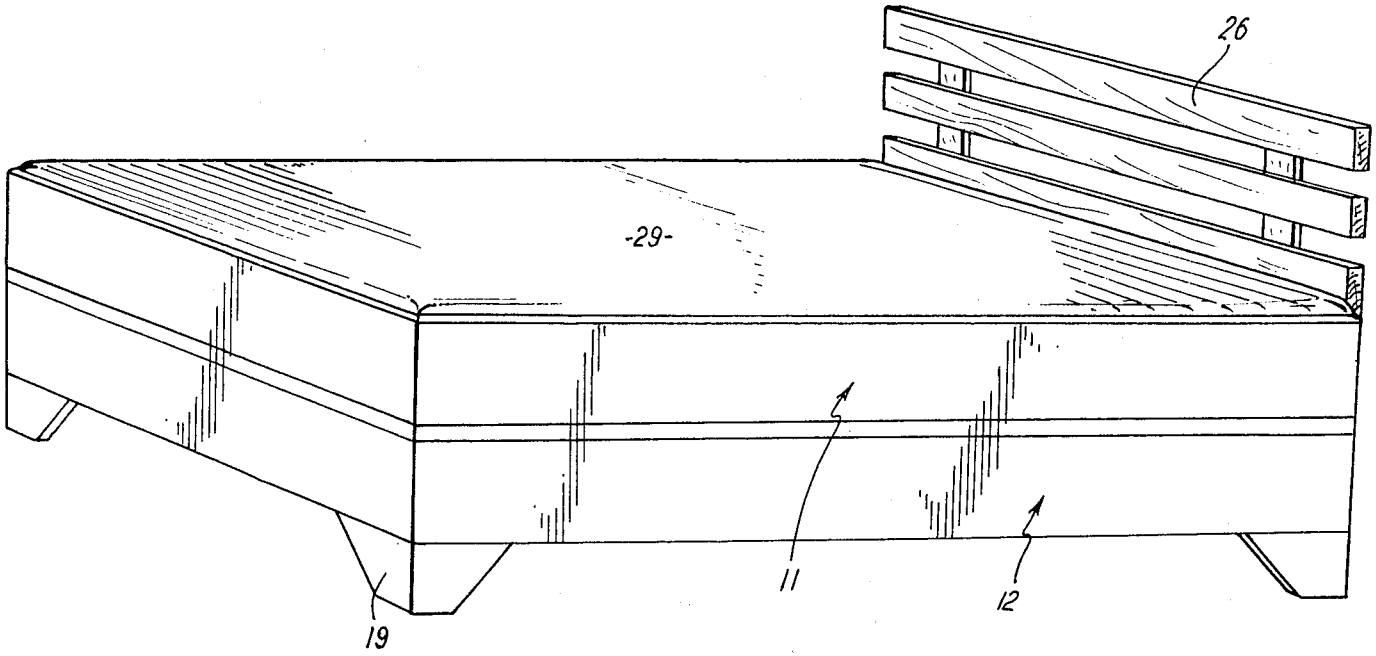

As shown in FIG. 3 part 12 may be placed above, i.e. on top of, part 11, again in alignment with each other. In this case the furniture is in the bed configuration and is supported on legs 19 of part 11. The legs 25 of part 12 are retracted into the lower recess 24 and are preferably retained in the inoperative position by a catch device, resilient biassing means or the like, (not shown) in order that no damage is caused thereby to the playing surface 13 of part 11. Since legs 25 are in the inoperative position the overall height of the furniture is less when in the bed configuration than when in the games table configuration. A mattress 29 is retained in the upper recess 23 of part 12 and other bedding as required is placed in conventional manner on the mattress 29. The headboard 26 is secured to part 12 whilst the furniture is in the bed configuration.

To convert the furniture from one configuration to the other the uppermost part is simply lifted off the lowermost part, legs 25 extended or retracted as appropriate, headboard 26 attached or detached as appropriate and then the previously lowermost part placed on top of the other part. No making or dismantling of the bedding is required in either case. Hand apertures or recesses may be provided in part 12 to assist such conversion if desired, the legs 19 of part 11 obviating the need for such apertures or recesses in that part.

It is envisaged that the furniture be made of pine, although any suitable wood may be used, with appropriate varnishing, staining or painting if desired. It is also envisaged that the furniture be of standard single bed size, i.e. 3 feet wide by 6 feet 3 ins. long (91 cm × 191 cm) although other sizes may be provided.

A further advantage of the furniture of the present invention lies in the fact that a second mattress may be placed on part 11 and the two parts used spearately as single beds if desired.

Although any design of headboard may be provided it is envisaged that the slatted type shown in FIGS. 1 and 3 is suitable since a marker board for the game being played on the table may be readily attached to, or formed on the back face of, the headboard is desired. Alternatively a marker board may be provided with hooks thereon whereby it may be hooked over the top of any other form of headboard.

I claim:

1. Convertible furniture comprising two parts, a first part having a top surface adapted for the playing of snooker or the like game thereon, and a second part being adapted to receive a mattress thereon, said two parts being adapted to be interchangeably located one above the other; each part being of like rectangular planform, having a respective lower surface and four corners thereof, and comprising a leg adjacent each corner of said respective lower surface; wherein each leg of said second part is mounted so as to be pivotal between an operative position in which said leg supports said second part and an inoperative position in which it lies substantially parallel with said lower surface of said second part.

2. Convertible furniture according to claim 1 wherein each part is of box-like construction having an interior, said top surface of said first part has six apertures therein, each of which communicates with said interior thereof, said interior of said first part has a floor inclined relative to said part and has an end wall with an aperture which communicates with said inclined floor.

3. Convertible furniture comprising two parts, a first part having a top surface with six apertures connected to the interior thereof and adapted for the playing of snooker pool, said first part being of rectangular box-like construction with a leg depending from each of the four corners thereof, a second part being adapted to receive a mattress thereon and of substantially identical rectangular box-like construction to said first part, said second part having four corners, and a leg adjacent each said corner mounted to pivot from an operative position in which the leg supports said second part to an inoperative position in which the said leg lies substantially parallel with said box-like second part, said first part when supported on its legs and resting on said second part supported on its legs in operative position being at normal snooker pool playing height and said second part when supported on said first part with the legs of said second part pivoted to inoperative position being at normal mattress height.

* * * * *